US005146830A

United States Patent [19]

Granger

[11] Patent Number: 5,146,830

[45] Date of Patent: Sep. 15, 1992

[54] UNIT TO SIMULTANEOUSLY DISPENSE AND CUT STRIPS OF ROLLED UP MATERIALS

[76] Inventor: Maurice Granger, 17 Ruse Marcel Pagnol 42270, Saint Priest En Jarez, France

[21] Appl. No.: 623,216

[22] Filed: Dec. 6, 1990

[30] Foreign Application Priority Data

Dec. 28, 1989 [FR] France ..... 8917570

[51] Int. Cl.[5] ..... A47K 10/36; B26D 1/58

[52] U.S. Cl. ..... 83/649; 83/337

[58] Field of Search ..... 83/649, 650; 225/15, 225/16, 72, 90; 63/337, 298

[56] References Cited

U.S. PATENT DOCUMENTS

| | | | |
|---|---|---|---|
| 3,558,254 | 1/1971 | Cahill | 83/649 X |
| 3,998,120 | 12/1976 | Granger et al. | 83/649 X |
| 4,307,638 | 12/1981 | De Luca et al. | 83/649 X |
| 4,635,837 | 1/1987 | Granger | 83/650 X |
| 4,819,528 | 4/1989 | Chadwick | 83/13 |
| 4,846,035 | 7/1989 | Granger | 83/649 X |

FOREIGN PATENT DOCUMENTS 2596034 3/1986 France .

*Primary Examiner*—Frank T. Yost
*Assistant Examiner*—Rinaldi Rada
*Attorney, Agent, or Firm*—Parkhurst, Wendel & Rossi

[57] ABSTRACT

The unit to simultaneously dispense and cut strips of rolled up material is outstanding in that part of the periphery of the drum, upstream to the cutting zone and either side of a continuous peripheral central strip defining the continuity of the cylinder and delimited by the lateral ends of the drum, has recesses or profiled openings made on a quadrant or determined peripheral plane and enabling the orientation and engagement of the corresponding parts of strips of materials in the event of the user angularly pulls the end of the strip of paper not in compliance with normal pulling which is defined as being in line with the front of the unit.

12 Claims, 2 Drawing Sheets

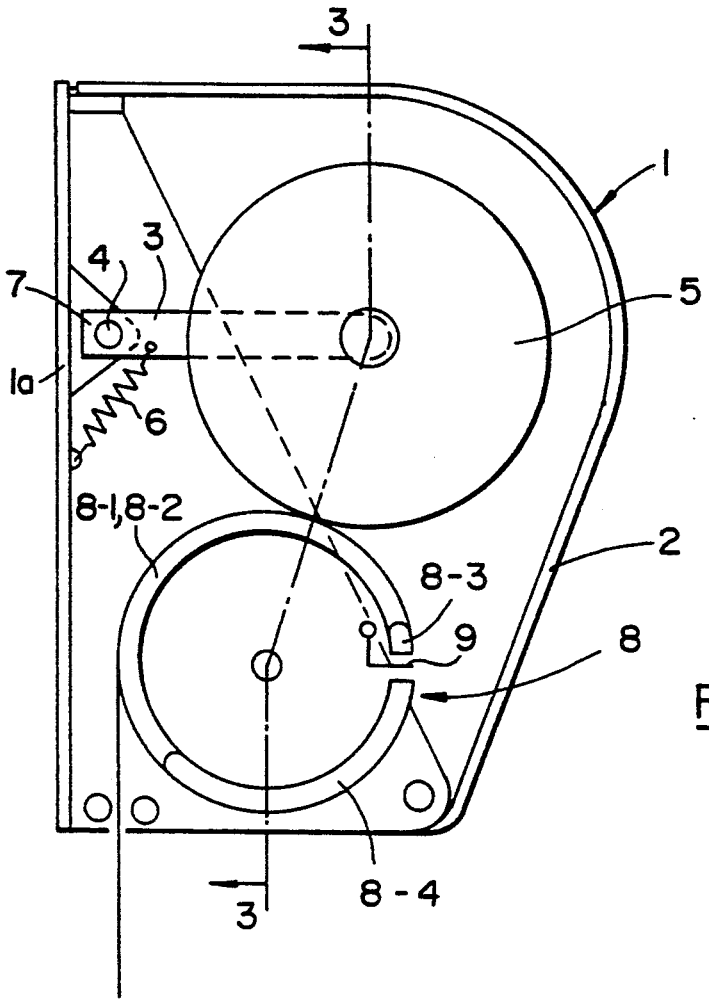
Fig- 1
Fig- 2
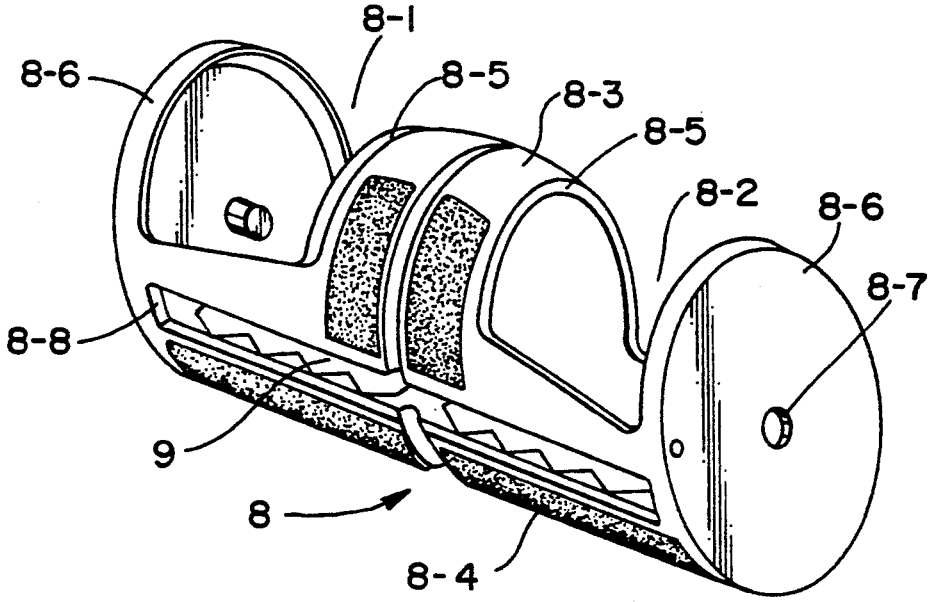

UNIT TO SIMULTANEOUSLY DISPENSE AND CUT STRIPS OF ROLLED UP MATERIALS

BACKGROUND OF THE INVENTION

1. Field of the Invention

The object of the invention is a unit to simultaneously dispense and cut strips of rolled up materials. The invention relates to the technical sectors of dispensing units for all types of wadded and similar paper capable, when in the form of strips of rolled up materials, being detached or split into pre-determined lengths.

2. Prior Art

The applicant has units of this type exercised and defined for example, in numerous French patents such as 2.182.404, 2.196.642, 2.212.076, 2.332.215, 2.340.887 and the equivalent foreign patents.

These units have the common feature of having a roll support fitted and positioned in a protective casing, this roll support being hinged and cooperating, by friction, with a drum, turned by simple manual pulling on the free end of material projecting from the unit.

At the end of the pulling operation, a cutting device, integrated or not integrated inside the drum, is provided to instantaneously cut the strip of material to the predetermined length. According to the arrangements known, the drum has a transversal slot in order for the cutting blade to pass which is moved by any known means such as those described in a non-limitating manner, in some of the aforementioned patents. Furthermore, throughout the periphery of the drum, excluding the zone of the slot, there are catching or gripping means of the emery cloth type or similar materials to facilitate the drive of the roll of strips of material.

The units which are fitted with these different means are widely used satisfactorily under certain conditions. However, during use, certain disadvantages or troubles have been noticed such varying directions in which the strip of material is pulled by the user. During normal use, the sheet of material is pulled in line with the front of the unit and sometimes the user may pull the material while being in an offset angular plane. In these conditions, the pulling forces are executed differently, and due to the contact of the material on the solid and catching surface of the drum, cutting may result in unexpected jagged tearing of the material, thus leaving very poor quality and unattractive strip ends. Furthermore, the material remains inside the unit and it is therefore necessary to carry out handling operations in order to make the end of the material project from the unit by making the drum turn.

Another disadvantage of such a device lies in the fact that there may be damage caused to the operating mechanisms of the unit depending on the frequency of the poor pulling manipulations.

Disadvantages are encountered with certain types of paper or wiping materials, particularly thin paper.

The aim according to the invention was therefore to overcome the aforementioned disadvantages by offering a new arrangement of the dispensing and cutting device for strips of rolled up materials.

This aim is reached without modifying the dispensing and cutting concept forming the object of the aforementioned patents and by a special arrangement of the drum.

SUMMARY OF THE INVENTION

According to a first feature of the invention, the dispensing and cutting device for strips of rolled up materials is of the type including, starting from a protective support casing, a roll support for the rolled up material, hinged in order to provide the support of the roll of material on a drum turned by manually pulling the free end of material, the drum being mounted on support means fixed to the protective casing and including a cutting device, the drum being arranged so as to make up a closed cylinder with a transversel slot in order for the cutting blade to pass, the drum having a catching surface on the outside, wherein one part of the periphery of the drum, upstream to the cutting zone at either side of a continuous peripheral central strip defining the continuity of the cylinder and delimited by the lateral ends of the drum, has recesses or profiled openings made on a quadrant or determined peripheral plane and provided for the orientation and engagement of the corresponding parts of strips of material in the event of angular pulling the end of the strip of paper by the user which is not in compliance with normal manual pulling defined in line with the front of the unit. These features and others shall be made apparent by the rest of the description.

BRIEF DESCRIPTION OF THE DRAWINGS

In order to clarify the object of the invention, however without limiting it, it is illustrated in the drawing, where:

FIG. 1 is a side view of a unit to simultaneously dispense and cut strips of rolled up material fitted with a drum according to the invention, FIG. 2 is a perspective view of the drum according to the invention, considered independently.

DESCRIPTION OF THE PREFERRED EMBODIMENTS

Figure 3:
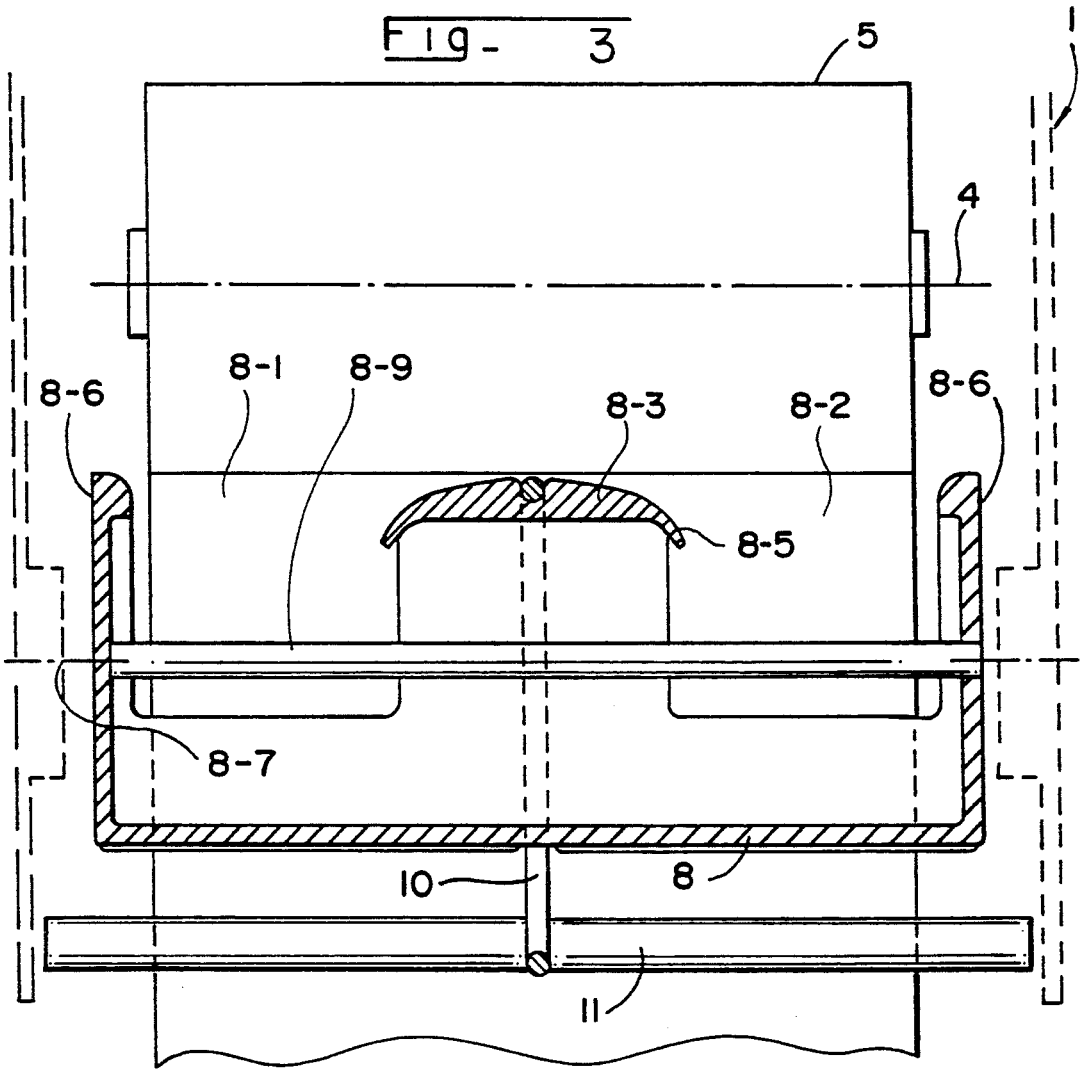
FIG. 3 is a section of the unit along line III—III of FIG. 1, illustrating normal and correct pulling of the end of the strip of rolled up material.
Figure 4:
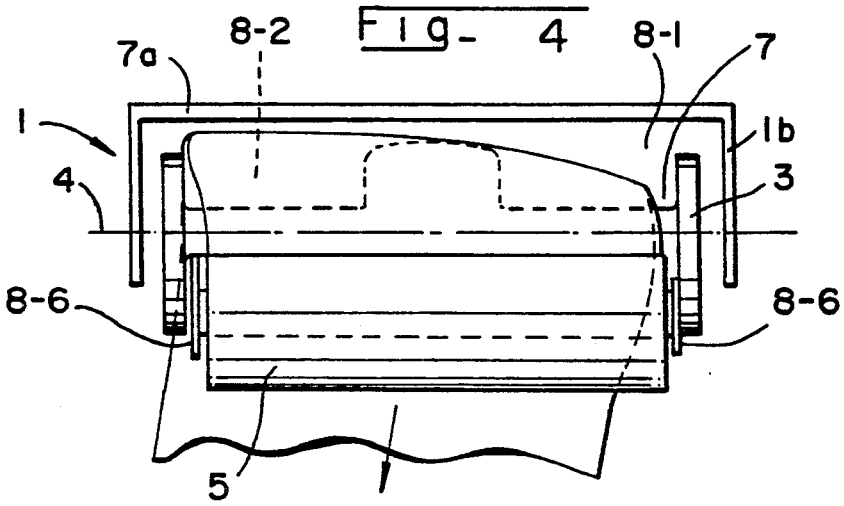
FIG. 4 is a schematic view showing the position of the strip of material around the drum in the event of pulling in an out-of-line angular plane.

The object of the invention will become more apparent from the following non-limiting description when considered in conjunction with the accompanying drawings.

The dispensing and cutting unit firstly includes a support and protective casing (1) with a support wall plate (1*a*), side plates (1*b*) and a protective cover (2) hinged on the said plates. The cover is locked in a closed position by any known means. The top part of the casing takes a roll support made up of one or two hinged arms (3) swivelling on a shaft (4) arranged on the bottom plate of the casing, the arms (3) being arranged at their top ends in order to hold the roll (5) of rolled up material, the arms (3) having hubs or similar means provided to position and clamp the roll mandrel.

Elastic return means (6) are hooked to at least one of the arms (3) to provide their elastic return towards the bottom. The arms (3) are coupled together by a connecting spacer (7) or the aforementioned assembly can be made from one single part. Elastic return means (6) is fixed at one end to one of the arms (3) or a connecting spacer (7) between the two arms (3) and the other end in a lower plane thereby being fixed to a lug or similar hooking means.

In a known manner, the device includes a drum (8) made up of a hollow cylinder part, periphery having a gripping zone provided by an emery cloth or similar material. In a lateral direction, the drum (8) has side plates (8-6) fitted with openings (8-7) to position rotation and support connecting shafts on the side plates of the casing. Furthermore, the unit includes a cutting device (9) for different successive sections of rolled up materials. This cutting device (9) may be arranged inside the drum (8) and may be retracted by means of a system of cams described for example in the French patents 2.332.215 and 2.340.887 of the applicant, the drum (8) therefore being fitted with a transversel slot (8-8) for the cutting blade to pass after the pulling force has been applied. As an alternative form, the cutting device (9) may be in a fixed position thereby being arranged on the drum according to the technique described, for example, in the patent FR 2.182.404.

Therefore, the strip of material is dispensed and cut by simply pulling the end of the strip of material by hand. According to the invention, in order to provide clean cutting of the strip of material, regardless of the angular direction of the paper during manual pulling, and to prevent the strip of material from staying in the unit, the drum is fitted with recesses or profiled openings (8-1) (8-2) on part of its periphery thereby leaving a continuous central strip (8-3) which appears between the recesses (8-1) (8-2). These recesses or openings are only made on part of the periphery of the drum thereby leaving a full solid zone (8-4) throughout the length of the drum and arranged to have a self-gripping external surface. This surface adjacently edges for example, the transversel slot (8-8) enabling the cutting blade to pass. Furthermore, the central strip (8-3) is also provided with a self-gripping external surface.

According to another arrangement, the connecting profile (8-5) of the openings or recesses (8-1) (8-2) with the solid part of the drum (8) is made in such a way that the strip of material is progressively and continuously guided and enables the possible support of the material in the event of pulling the strip of material out-of-line. This profile (8-5) is sloped internally, for example at 45 degrees and is made throughout or on part of each of the lateral ends of the central strip (8-3).

Such openings or recesses (8-1) (8-2) therefore offer the advantage of enabling the strip of material pulled angularly out-of-line to partially penetrate into the drum (8) and thereby not rub against drum (8) it which would create, as explained according to the prior art, unexpected and jagged tearing of the material and its jamming in position inside the unit. Quite the contrary, the breaking and tearing effect is made from the median central zone (8-3) of the drum (8) thereby naturally continuing either side when the drum is turned.

As shown on the drawings, the openings or recesses have, in a transversel manner, a profile decreasing from the outside to the inside in order to assist the unrolling of the material. The openings or recesses are arranged upstream to the cutting device, i.e. before it is activated. Consequently, the same applies to the central zone (8-3) which alone, provides the support of the roll of material. By referring to FIG. 1, it can be seen that when the drum (8) is in the position before pulling and cutting a strip of material, the openings (8-1) (8-2) are located at the rear, opposite the bottom of the casing of the unit whereas a cutting device was illustrated in a non-limitating manner.

Therefore, the advantages of the invention are made clearly apparent. Besides the reduction in weight of the drum, the saving in material due to the new arrangement of the drum and the very reliable operation of the unit regardless of the pulling positions of the strip of paper by the user are enhanced. The cut is clean, perfect, rectilinear and independent from any material pulling considerations.

The drum according to the invention can be used for all cutting systems implementing the driving concept of the drum by manual pulling the material by an operator.

Another advantage according to the invention is that the technical problem has been solved without adding parts or additional means, rather, on the contrary, by further simplifying the production of the unit and drum in particular. Furthermore, thanks to the new design of the drum, the material may no longer stay in the unit.

Whilst remaining within the scope of the invention, the drum as so designed, can be made in one or two parts assembled by any desired means. As an addition, a spacer bar (8-4) may be provided connecting the end side jaws of the drum in order to provide it with more rigidity.

In order to complete the drawings, known means, already described in the patents of the applicant have been illustrated in order to facilitate, for example, the drive of the drum and tracking of the strip of material. This refers, in particular, to a belt (10) centered on a median groove of the drum and returned by a bar (11) arranged in the bottom part of the unit.

I claim:

1. A material dispenser for dispensing predetermined lengths of a material from a roll of material comprising:

support means for supporting said roll of material; and an axially supported generally cylindrical rotatable drum disposed radially adjacent to said roll of material wherein said drum comprises:

a) cutting means for cutting said material including a transverse slot and a cutting blade which protrudes therethrough;

b) a gripping surface which cooperates with material from said roll of material thereby preventing slippage of said material on said gripping surface;

c) means for receiving a portion of said material therein thereby enabling proper disposal of predetermined lengths of material upon pulling an end of said roll of material substantially independent of a pulling angle defined by the angle between the pulling direction and a central axis of said drum, said means comprising at least two peripheral recesses disposed on said drum; and d) a continuous central strip located between and defined by said two recesses.

2. The dispenser of claim 1, wherein said at least two recesses only partially circumvent said drum thereby leaving a remaining external surface of said drum, at least a portion of which defines said gripping surface.

3. The dispenser of claim 2, wherein said transverse slot is disposed in said external surface.

4. The dispenser of claim 1, wherein said gripping surface is at least partially defined by said continuous central strip.

5. The device of claim 1, wherein said cutting blade is retractable for a position within said drum.

6. The dispenser of claim 1, wherein said cutting blade has a fixed position.

7. The dispenser of claim 1, further comprising a spacer bar disposed between side plates of said drum for connecting said side plates to each other and providing a rigid support for said drum.

8. The dispenser of claim 1, wherein said continuous central strip axially tapers from a given radial value to a value lower than said given radial value from a central position to the outermost axial edges of said central strip.

9. The dispenser of claim 1, wherein said central strip further comprises connecting profiles disposed at least partially circumferentially on the outermost axial edges of said central strip, wherein said connecting profiles axially taper from a given radial value to a value lower than said given radial value from said continuous central strip to outermost axial edges of said connecting profiles.

10. The dispenser of claim 9, wherein said flange portions taper at an approximate 45° angle with respect to the central axis of said drum.

11. The dispenser of claim 1, wherein said support means for said roll of material comprises:

two arms wherein one end of each arm is pivotally attached to a fixed member, and an opposite end of each arm supports said roll of material; and an elastic return means connected to said arms for biasing said roll toward said drum.

12. The dispenser of claim 11, wherein said elastic return means comprise a spring.

* * * * *